US007871653B2

(12) United States Patent
Lin

(10) Patent No.: US 7,871,653 B2
(45) Date of Patent: Jan. 18, 2011

(54) DOUBLE-STACK SHRIMP TRAY

(75) Inventor: Duke Lin, Rancho Palos Verdes, CA (US)

(73) Assignee: Ocean Duke Corporation, Torrance, CA (US)

( * ) Notice: Subject to any disclaimer, the term of this patent is extended or adjusted under 35 U.S.C. 154(b) by 556 days.

(21) Appl. No.: 12/022,259

(22) Filed: Jan. 30, 2008

(65) Prior Publication Data

US 2009/0191317 A1 Jul. 30, 2009

(51) Int. Cl.
*B65D 81/32* (2006.01)

(52) U.S. Cl. ..... 426/115; 426/129; 220/23.86

(58) Field of Classification Search ..... 426/115, 426/129; 226/23.86, 23.87, 23.83; 206/515, 206/503, 505, 501
See application file for complete search history.

(56) References Cited

U.S. PATENT DOCUMENTS

| | | | |
|---|---|---|---|
| 1,949,285 | A | 2/1934 | Porter |
| D160,688 | S | 10/1950 | Brock |
| 3,951,079 | A | 4/1976 | Tolleson |
| D272,212 | S | 1/1984 | Daenen et al. |
| 5,413,801 | A | 5/1995 | McIlwain |
| D364,090 | S | 11/1995 | Krupa |
| D394,985 | S | 6/1998 | Curtis et al. |
| D396,606 | S | 8/1998 | Blazevich |
| D401,810 | S | 12/1998 | Swift |
| 5,843,500 | A | 12/1998 | Guarino |
| D404,612 | S | 1/1999 | Blazevich |
| 5,869,120 | A | 2/1999 | Blazevich |
| 5,894,944 | A | 4/1999 | Swift |
| D411,709 | S | 6/1999 | Curtis et al. |
| D420,285 | S | 2/2000 | Sagan et al. |
| 6,021,903 | A | 2/2000 | Hanson |
| 6,022,571 | A | 2/2000 | Blazevich |
| 6,042,856 | A | 3/2000 | Sagan et al. |
| D422,907 | S | 4/2000 | Sagan et al. |
| 6,168,813 | B1 | 1/2001 | Blazevich |
| D452,146 | S | 12/2001 | Lin |
| D460,897 | S | 7/2002 | Leuenberger |
| D461,099 | S | 8/2002 | Leuenberger |
| D464,531 | S | 10/2002 | Blazevich |
| 6,514,548 | B2 | 2/2003 | Lin |
| 6,520,352 | B2 | 2/2003 | Mondragon |
| D481,593 | S | 11/2003 | Blazevich |
| 6,681,684 | B1 | 1/2004 | Chen |
| 6,863,912 | B2 | 3/2005 | Lin |
| 2003/0129284 | A1 | 7/2003 | Leuenberger |
| 2007/0062965 | A1 * | 3/2007 | Anderson et al. ..... 220/912 |

* cited by examiner

*Primary Examiner*—Keith D Hendricks
*Assistant Examiner*—Chaim Smith
(74) *Attorney, Agent, or Firm*—Kelly Lowry & Kelley, LLC

(57) ABSTRACT

A tiered shrimp food tray including a sheet of material forming a base tray having an outer ridge, a support ridge formed concentric to and in spaced relation to the outer ridge. An inner ridge and a base surface cooperatively define a central well which supports a condiment cup. A ring of shrimp is arranged on the support ridge of the base tray. A connector plate interconnects the base tray with an upper tray. The upper tray includes an outer ridge and a support ridge spaced from one another. A second condiment cup is disposed within a well of the upper tray. A ring of shrimp is arranged on the support ridge of the upper tray.

18 Claims, 6 Drawing Sheets

DOUBLE-STACK SHRIMP TRAY

BACKGROUND OF THE INVENTION

The present invention generally relates to food serving trays. More particularly, the present invention relates to a serving tray for shrimp.

Numerous trays are known for serving and presenting food. Although generally satisfactory, such prior art trays are not readily adaptable for serving shrimp and associated condiments, such as cocktail sauce. Prior to serving shrimp, they are peeled, deveined and cooked. During this process, the inedible tail portion is often left attached to the fleshy edible portion of the shrimp. After cooking, the shrimp are then rinsed and served, or frozen for later consumption. One common way of serving shrimp is by chilling them first and then serving them on a serving tray together with a suitable condiment. Often times, such shrimp are arranged on a tray and frozen for later use.

U.S. Pat. No. 6,514,548 discloses a shrimp tray which provides a ring of frozen shrimp placed side-by-side, and a condiment cup placed in the center of the tray. Such an arrangement is aesthetically pleasing, and lends itself to stacking, transport and storage. However, in many instances, it is desirable to offer a larger number of shrimp than are available in a single tray. For transport, storage, and display purposes in a store, the size or width of the tray is often restricted. Moreover, consumers may want to have two trays for placement at different locations to provide better access to their party guests.

Accordingly, there is a continuing need for a tray arrangement that is especially adapted for serving and presenting shrimp and condiments in an appealing manner. There is also a continuing need for providing multiple trays with shrimp in a manner which is both visually appealing and convenient. The present invention fulfills these needs, and provides other related advantages.

SUMMARY OF THE INVENTION

The present invention is embodied in a simple, easy-to-make, tiered serving tray that presents shrimp and condiments in an appealing fashion. The present invention, as will be more fully described herein, presents a two tray tiered arrangement which is both visually appealing to the consumer and provides two distinct shrimp trays for placement in two different locations.

The tiered shrimp tray of the present invention includes a base tray comprising a sheet of material having an outer ridge. The outer ridge includes a raised outer wall and a raised inner wall in spaced relation to one another. A support ridge is formed concentric to and in spaced relation to the outer edge. The support ridge also includes a raised outer wall and a raised inner wall. The inner wall has a sloped surface. The outer ridge and support ridge of the base tray defines a gap having a base surface. An inner raised ridge and a base surface cooperatively define a central well, in which is disposed a condiment cup.

A plurality of shrimp, each having a concave bottom surface is supported by the support ridge of the base tray. The shrimp is arranged side-by-side to one another so as to form a ring structure on the base tray. Each shrimp has a tail end directed towards the cup, and a head end directed towards the outer ridge.

A connector plate, comprising a sheet of material, has an outer ridge and a groove concentric to and in spaced relation to the outer ridge. The groove defines a cavity on a lower surface of the connector plate which is configured to receive an upper portion of the cup therein.

An upper tray comprises a sheet of material having a smaller diameter than the base tray. The upper tray includes a raised outer wall and raised inner wall in spaced relation forming an outer ridge. The outer ridge defines a groove on a bottom surface of the upper tray which is configured to receive the outer ridge of the connector plate. A support ridge, defined by an outer wall and an inner wall having a sloped surface, is formed concentric to and in spaced relation to the outer ridge. The support ridge also defines a periphery of a well base platform. A second condiment cup is disposed within the well base platform of the upper tray.

A plurality of shrimp, each having a concave bottom surface supported by the support ridge of the upper tray, are arranged side by side to one another, with the tail end directed towards the cup and a head end directed towards the outer ridge so as to form a ring structure on the upper tray. Preferably, both the base and upper trays are circular, and the outer ridge and the support ridge of the base and upper trays are generally annular.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the accompanying drawings, for purposes of illustration, the present invention resides in a tiered shrimp tray, generally referred to by the reference number 10. The double-stack shrimp tray 10 of the present invention is particularly adapted for packaging, shipping, storing and serving frozen shrimp. As will be more fully described herein, the shrimp tray 10 of the present invention presents an aesthetically appealing presentation of frozen shrimp, and enables the end user to purchase two shrimp trays in a single package for placement at different locations to serve party guests.

Figure 1:
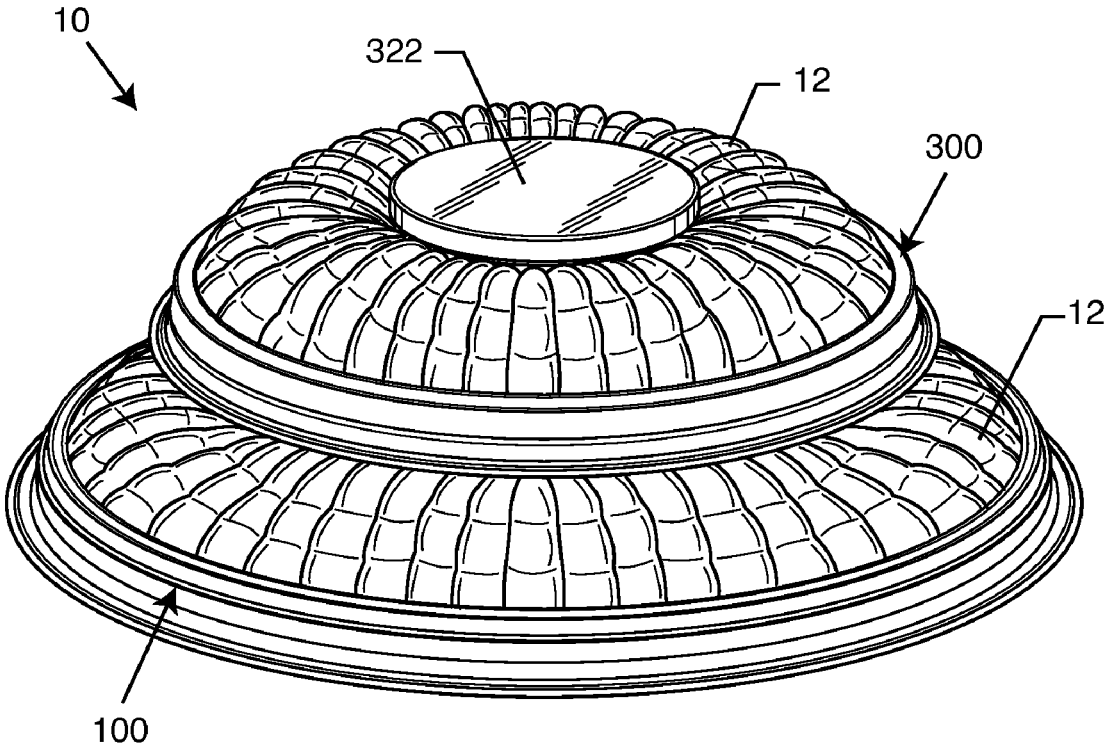
FIG. 1 is a side perspective view of the tiered food tray, embodying the present invention, having shrimp arranged thereon.
Figure 2:
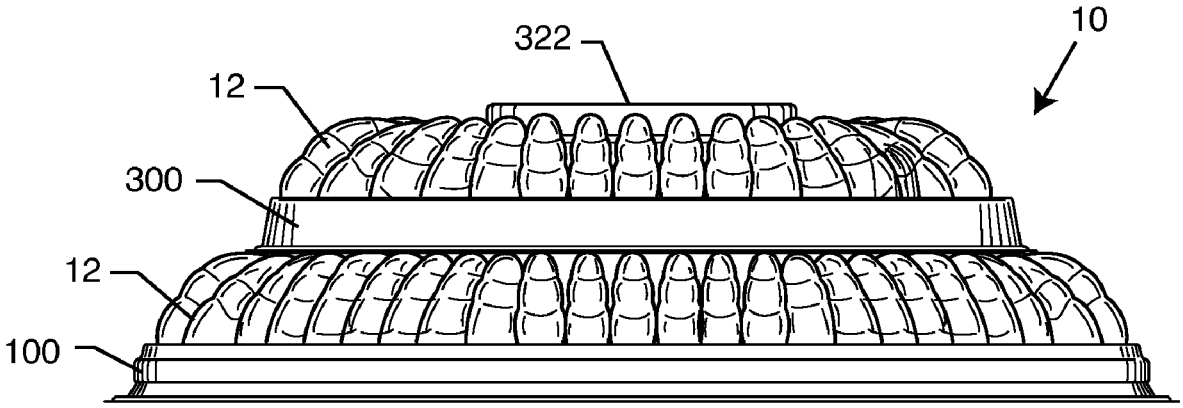
FIG. 2 is a side elevational view of the tiered shrimp tray of FIG. 1.
Figure 3:
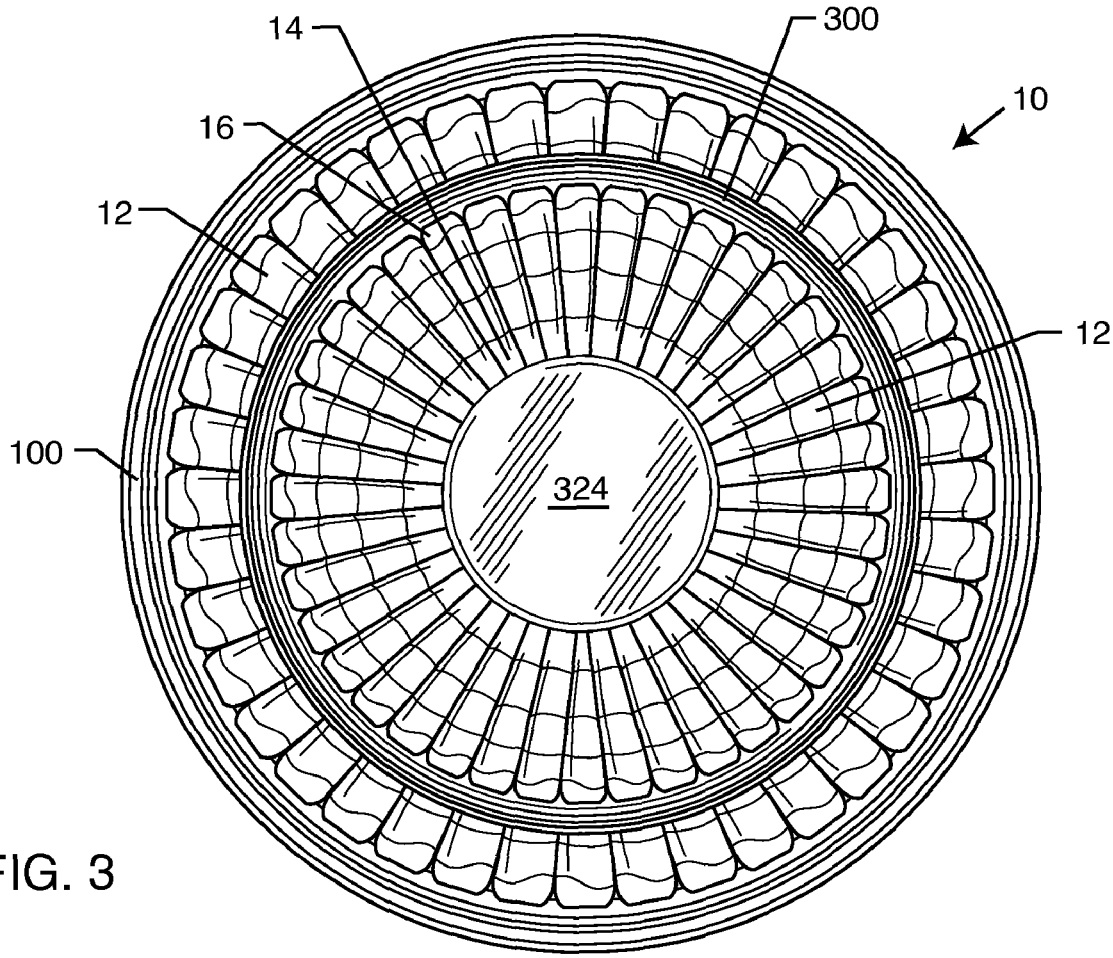
FIG. 3 is a top plan view of the tiered shrimp tray of FIG. 1.

With reference now to FIGS. 1-3, the double-stack, tiered shrimp tray 10 in its final assembled form is shown. A base tray 100 supports a plurality of shrimp 12 formed in a ring-like structure. An upper tray 300, which is of reduced diameter with respect to the lower tray 100 also supports a plurality of shrimp 12 which are arranged side-by-side to form a ring structure on the upper tray 300. As will be more fully described herein, the upper tray 300 is removably associated with the lower tray 100, such that the trays 100 and 300 can be separated from one another during use.

Figure 4:
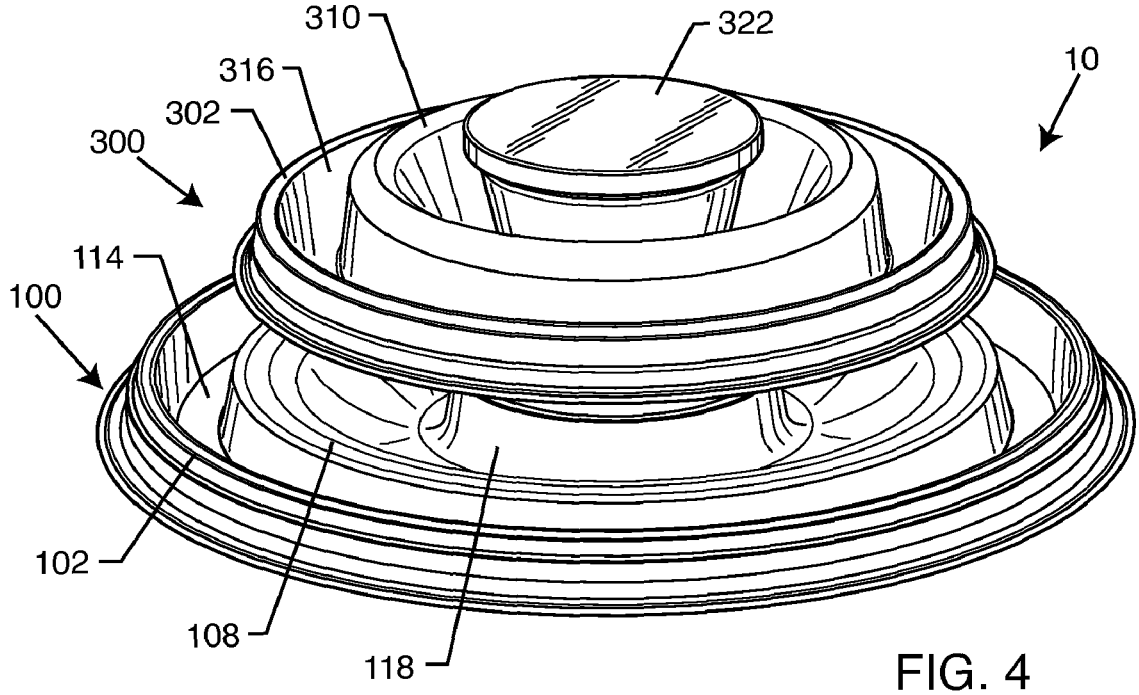
FIG. 4 is a front perspective view of the tiered food tray embodying the present invention, without shrimp disposed therein.
Figure 5:
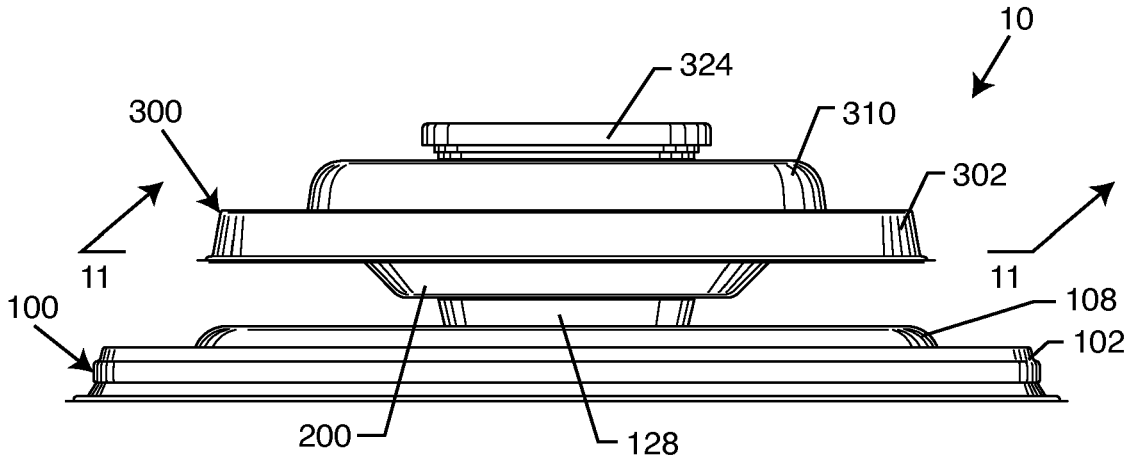
FIG. 5 is a side elevational view of the tiered food tray of FIG. 4.
Figure 6:
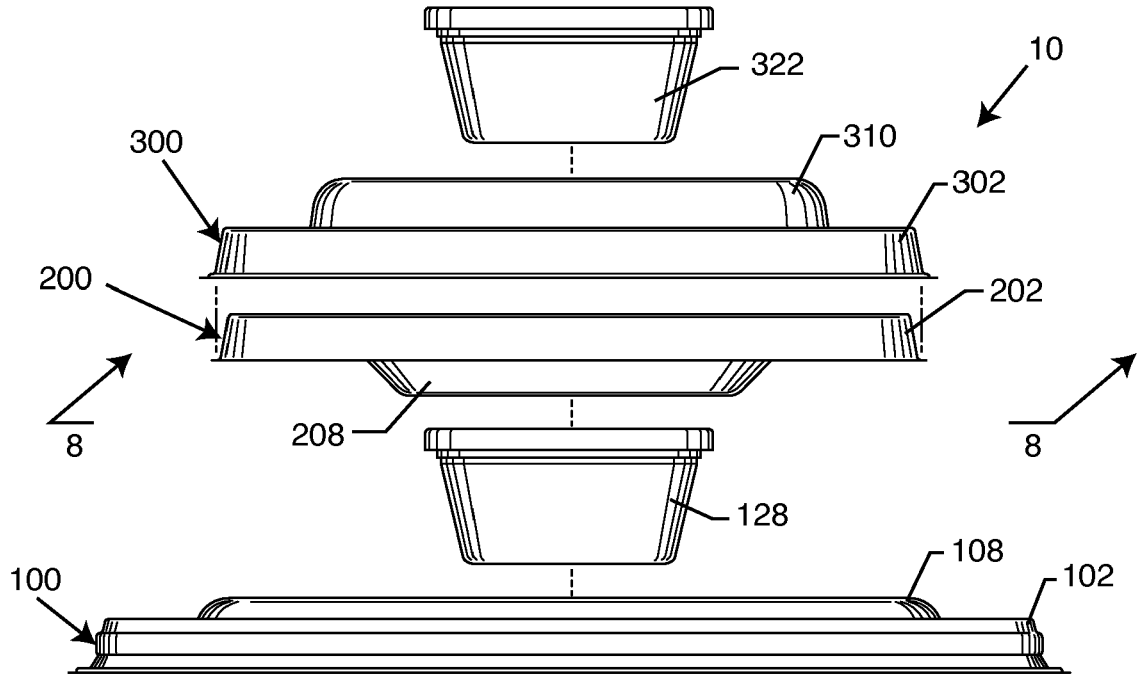
FIG. 6 is an exploded side elevational view of the tiered food tray.
Figure 7:
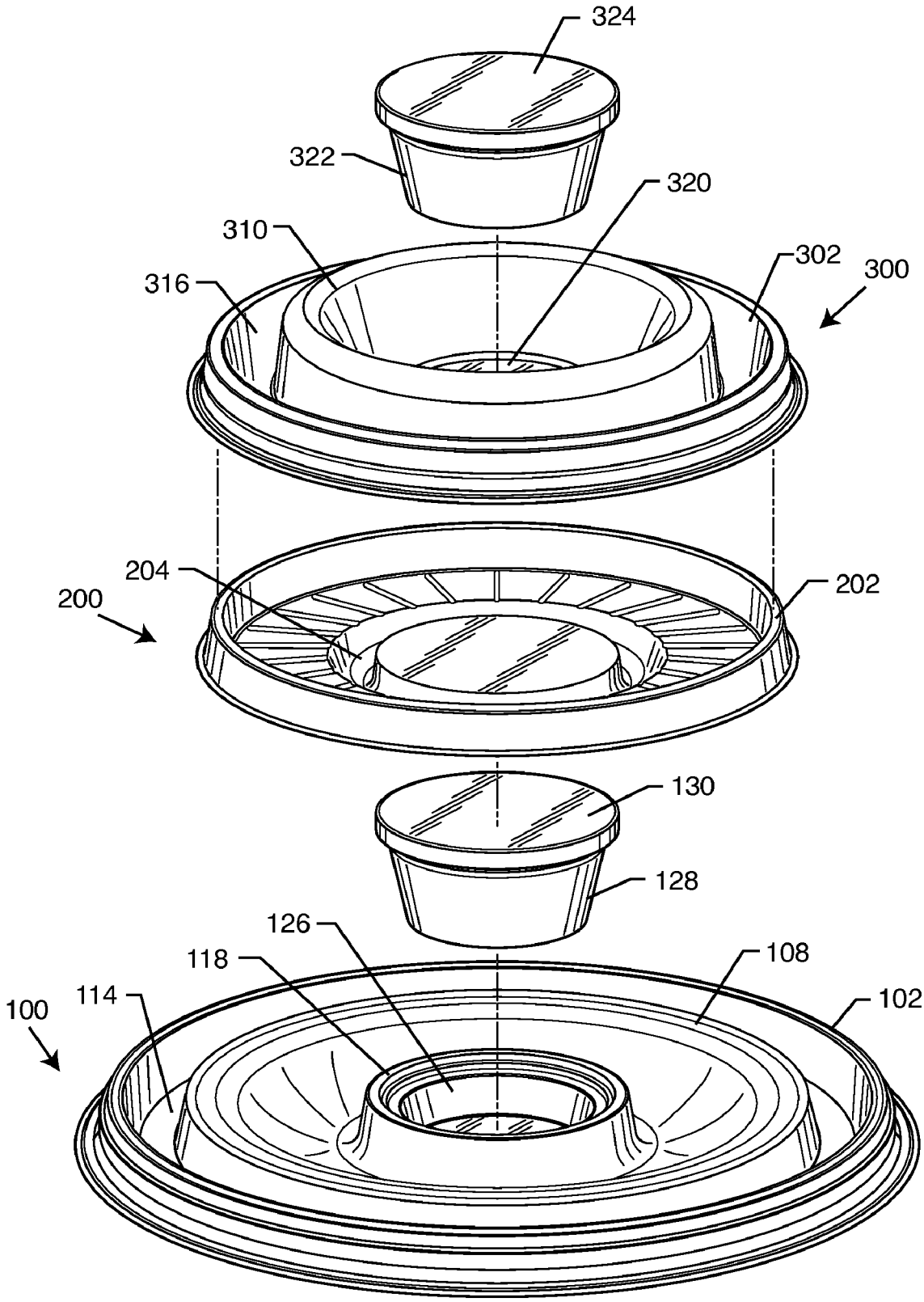
FIG. 7 is a perspective exploded view of the tiered food tray of the present invention.

With reference now to FIGS. 4-7, the tiered shrimp tray 10 of the present invention is shown without the arrangement of shrimp thereon. In FIG. 4, the various components of the tiered tray 10 are shown in an assembled state. FIGS. 6 and 7 are exploded views of the shrimp tray 10.

Figure 8:
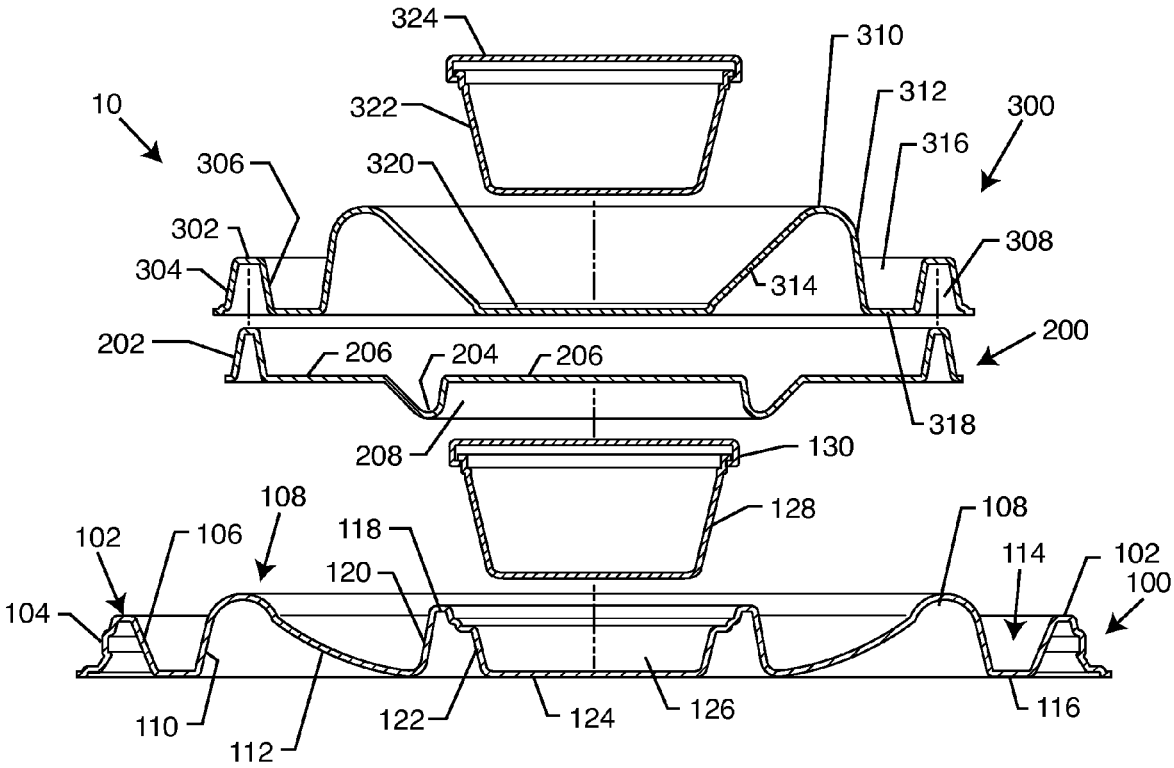
FIG. 8 is a cross-sectional view taken generally along line 8-8 of FIG. 6.

With particular reference now to FIGS. 7 and 8, the base tray 100 is typically comprised of a single sheet of material, such as a single sheet of plastic which may be made, for example, by thermoforming or vacuforming, or any other known manufacturing method. Preferably, the base tray 100 is of a circular configuration, although it is not limited to such. The base tray 100 includes an outer ridge 102 which is typically annular in configuration. The outer ridge 102 is defined by an outer wall 104 and an inner wall 106 which are connected at a top portion thereof, and typically spaced apart from one another at a lower portion thereof, as illustrated in FIG. 8. A support ridge 108 is formed generally concentric to and in spaced-apart relation to the outer ridge 102. The support ridge 108 is defined by an outer wall 110 and a connected inner wall 112. The inner wall 112 is sloped so as to support the shrimp 12 thereon. The space between the outer ridge 102 and the support ridge 108 defines a gap or groove 114, which includes a base surface 116 extending between the outer ridge 102 and the support ridge 108. Typically, the support ridge 108 and the base surface 116 are annular in configuration.

An inner ridge 118 is formed generally concentric to and in spaced-apart relation to the support ridge 108. The inner ridge 118 is defined by an outer wall 120 and an inner wall 122. The inner wall 122 extends upwardly and generally encircles a central base surface 124. The inner ridge 118 and the central base surface 124 cooperatively define a well 126. A condiment cup 128 is sized and configured so as to be received within the well 126. Preferably, the condiment cup 128 includes a lid 130.

The tiered shrimp tray of the present invention also includes a connector plate or member 200. Referring again to FIGS. 7 and 8, the connector plate also typically comprises a single sheet of material, such as plastic, which can be thermoformed, vacuformed or the like. The connector plate 200 includes a raised outer ridge 202, typically adjacent to a perimeter thereof. As can be seen in FIGS. 7 and 8, the connector plate 200 is of reduced diameter with respect to the base plate 100, and is slightly smaller or of approximately the same diameter as the upper plate 300 in a preferred embodiment. Typically, the outer ridge 202 is generally annular in configuration. A generally annular groove 204 is formed in the sheet of material, which extends downwardly from the base surface 206. The generally annular groove defines a cavity 208 which is sized and configured so as to receive an upper portion, typically the lid 130, of the cup 128 of the base tray 100. The cavity 208 is of a slightly larger diameter than the lid 130 such that the connector plate 200 can be easily removably received onto and away from the cup 128.

With continuing reference to FIGS. 7 and 8, the upper tray 300, similar to the lower tray 100 and connector plate 200 is preferably comprised of a single sheet of material, such as plastic, which can be thermoformed, vacuformed, etc. into the necessary configuration to achieve the purposes of the present invention. The upper plate 300 includes a raised outer ridge 302 defined by an outer wall 304 and an inner wall 306. As can be seen in FIG. 8, the outer and inner walls 304 and 306 are joined at a top portion thereof, but are spaced apart from one another at a lower portion thereof so as to form a groove 308 on a bottom surface of the upper tray 300. The groove 308 is sized and configured so as to receive the outer ridge 202 and the connector plate 200 therein, in a friction-fit manner. A support ridge 310 is formed generally concentric to and in spaced-apart relation to the outer ridge 302. It is defined by an outer wall 312 and an inner sloped wall 314. The outer and inner wall 312 and 314 are typically interconnected at a top portion thereof, and in spaced-apart relation to the bottom portion thereof, as illustrated in FIG. 8.

The outer ridge 302 and support ridge 310 define a gap or groove 316 therebetween, including a base surface 318 which extends between the inner wall 306 of the outer ridge 302 and the outer wall 312 of the support ridge 310. Typically, the upper tray 300 is generally circular, and the raised support ridge 302, base surface 318, and support ridge 310 are generally annular.

The inner sloped wall 314 of the support ridge 310 extends upwardly about a periphery of a well-based platform 320. The platform 320 and the inner wall 314 of the support ridge 310 form a well for receiving a second condiment cup 322 therein. Typically, the condiment cup 322 includes a lid 324 for retaining the condiment, typically shrimp cocktail sauce therein. It will be understood by those skilled in the art that the lids 130 and 324 of the condiment cups 128 and 322 can comprise removable lids, or can comprise plastic or foil or the like which covers and encloses the contents within the cups 128 and 322.

Figure 9:
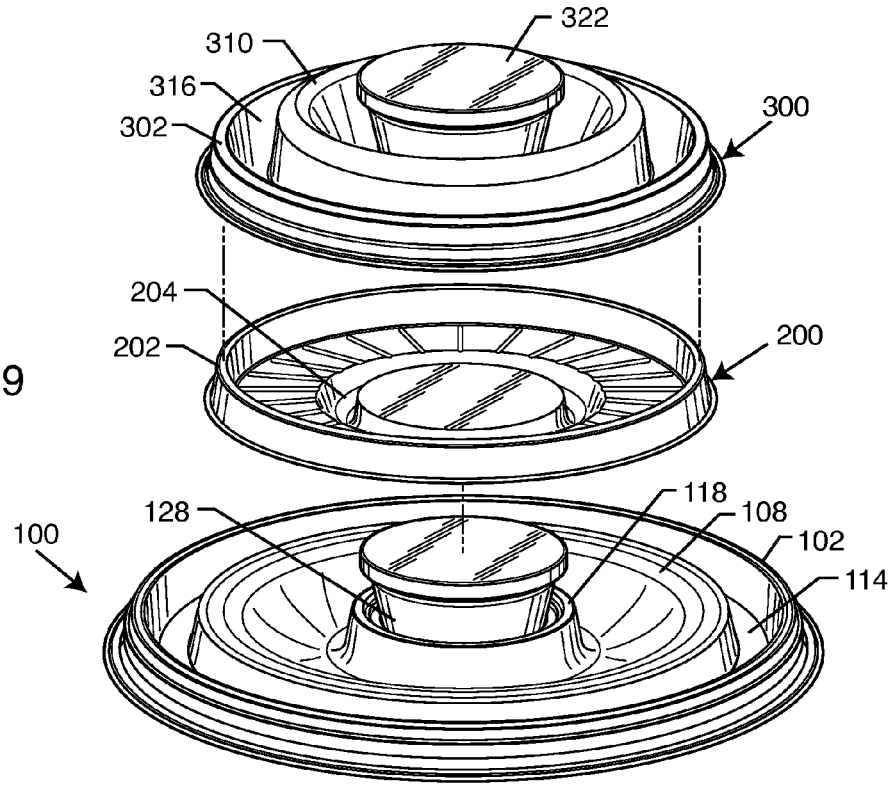
FIG. 9 is a partially exploded perspective view of the tiered food tray of the present invention.
Figure 10:
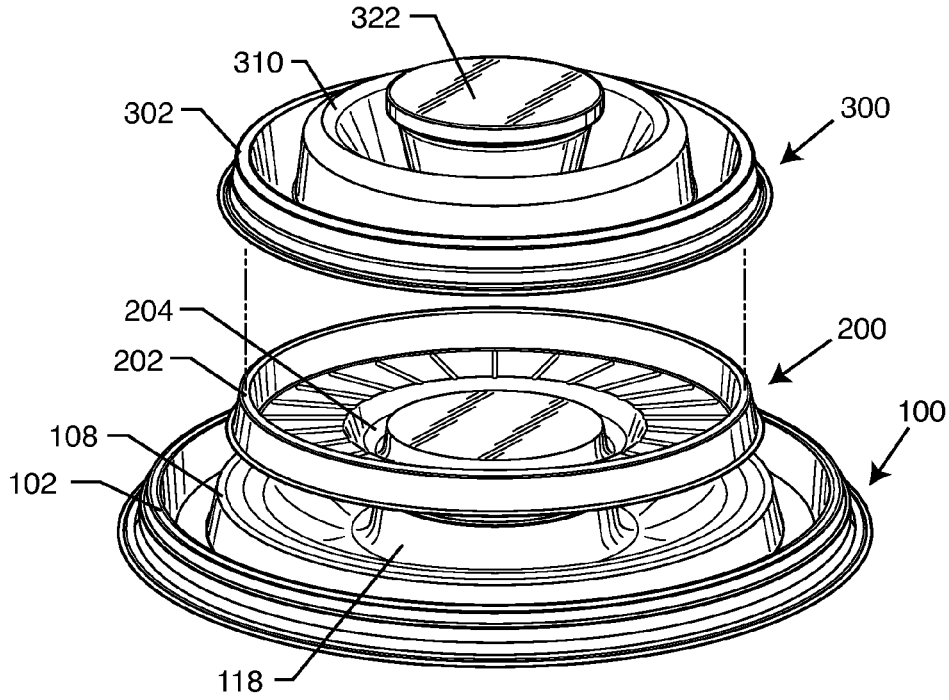
FIG. 10 is a partially exploded perspective view of the tiered food tray, illustrating partial assembly thereof.
Figure 11:
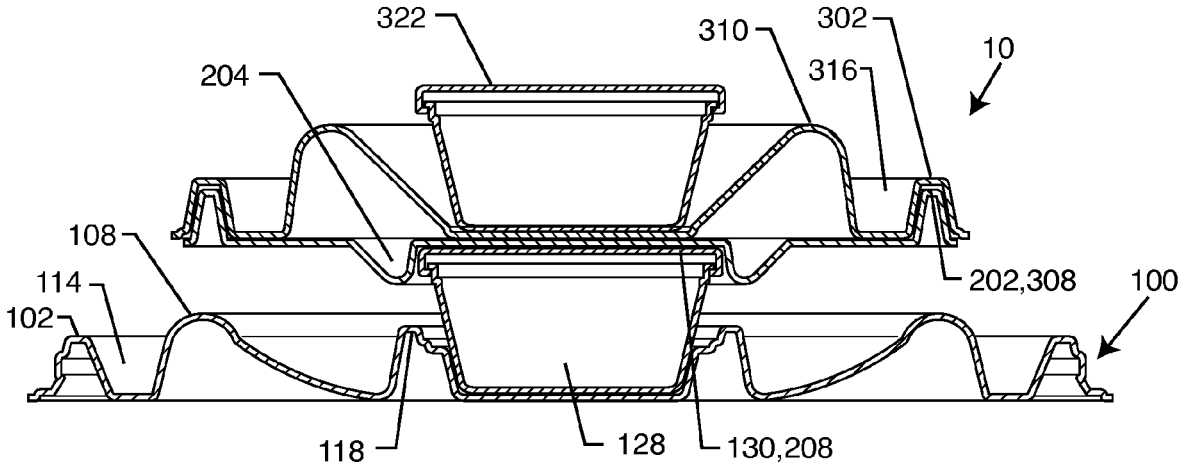
FIG. 11 is a cross-sectional view taken generally along line 11-11 of FIG. 5.

With reference now to FIGS. 9-11, in order to assemble the tiered tray 10 of the present invention, the cup 128 is placed within wall 126. Shrimp are arranged on the support ridge to form a ring-like structure. As shown in FIGS. 1-3, the shrimp 12 have a generally concave bottom surface which generally conforms to the support ridge 108. The tail 14 of each shrimp 12 is directed towards the inner ridge 118 and condiment cup 128. The shrimp extends over the support ridge 108, with its head portion 16 residing within groove or gap 114, so as to extend toward and typically abut the outer ridge 102. The shrimp are arranged in this manner side-by-side in order to form the ring-like structure illustrated in FIGS. 1-3.

With reference again to FIGS. 9-11, the connector plate 200 is then placed over the cup 128, such that an upper portion of the cup 128, typically the lid 130, resides within cavity 208. This is particularly illustrated in FIG. 10.

The upper tray 300 has its condiment cup 322 disposed on its central well based platform 320. A plurality of shrimp 12 are arranged in a ring-like structure, as described with respect to the base plate 100. More particularly, a bottom concave surface of the shrimp are supported by the support ridge 310. A tail end 14 of each shrimp extends towards the condiment cup 322. A head end of the shrimp 16 extends into groove or gap 316 towards the wall 306 of the raised outer ridge 302, so as to be held in place. The shrimp 12 are arranged side-by-side to form the ring-like structure illustrated in FIGS. 1-3. The upper tray 300, is then placed over the connector plate such that the outer ridge 202 of the connector plate 200 is disposed within the lower groove 308 defined by the raised outer ridge 302 of the upper tray 300. The result is a friction-fit between the cup 128 of the base tray 100 and the cavity 208 of the connector plate 200, and a frictional fit between the raised outer ridge 202 of the connector plate and the bottom surface groove 308 of the upper tray 300. This arrangement is shown in FIGS. 4, 5 and 11, without shrimp, and in FIGS. 1-3 with shrimp thereon. When fully assembled, the tiered shrimp tray is encased in plastic or the like for shipping, transport, and sale. The end user is provided with an aesthetically pleasing two-tiered, or double-stacked, shrimp tray arrangement 10. Moreover, the end user can separate the upper tray 300 from the lower tray 100 such that two distinct shrimp trays are made available to party guests and the like.

Although several embodiments have been described in some detail for purposes of illustration, various modifications may be made without departing from the scope and spirit of the invention. Accordingly, the invention is not to be limited, except as by the appended claims.

What is claimed is:

1. A tiered shrimp tray, comprising:

a base tray comprising a sheet of material having an outer ridge, a support ridge formed concentric to and in spaced relation to the outer ridge, and an inner ridge encircling a base surface and cooperatively defining a central well;

a cup disposed within the central well;

a connector plate comprising a sheet of material having an outer ridge and a groove concentric to and in spaced relation to the outer ridge, the groove defining a cavity on a lower surface of the connector plate configured to receive an upper portion of the cup therein; and an upper tray comprising a sheet of material having an outer ridge defining a groove on a bottom surface of the upper tray configured to receive the outer ridge of the connector plate, and a support ridge and including a plurality of shrimp disposed on the support ridges of the base and upper trays formed concentric to and in space relation to the outer ridge.

2. The tiered shrimp tray of claim 1, wherein each shrimp has a concave bottom surface in contact with the support ridge, and opposite side surfaces which are adjacent to a side surface of an adjacent shrimp, such that the plurality of shrimp form a ring structure on the support ridges of the base and upper trays.

3. The tiered shrimp tray of claim 2, including a second cup disposed within a well of the upper tray defined by the support ridge and a base surface.

4. The tiered shrimp tray of claim 2, wherein each shrimp has a tail end directed towards the cup, and a head end directed towards the outer ridge of the base and upper tray.

5. The tiered shrimp tray of claim 1, wherein the outer ridge of the base tray and the upper tray each include an outer wall and an inner wall connected at an upper portion thereof and in spaced relation at a lower portion thereof.

6. The tiered shrimp tray of claim 1, wherein the support ridge of the base tray and the upper tray each include an outer wall connected to an inner wall having a sloped surface.

7. The tiered shrimp tray of claim 1, wherein the outer ridge and the support ridge of each of the base and upper trays define a gap having a base surface extending therebetween.

8. The tiered shrimp tray of claim 1, wherein the outer ridge and the support ridge of each of the base and upper trays are generally annular.

9. The tiered shrimp tray of claim 1, wherein the base tray has a first diameter, and the upper tray has a second diameter that is smaller than the first diameter.

10. A tiered shrimp tray, comprising:

a base tray comprising a sheet of material having an outer ridge including connected outer and inner raised walls, a support ridge having connected inner and outer raised walls formed concentric to and in spaced relation to the outer ridge, the inner wall of the support ridge having a sloped surface, the outer and support ridges defining a gap having a base surface extending therebetween, and an inner ridge having a raised outer wall connected to an inner wall extending upwardly from a central base surface to define a central well;

a cup removably disposed within the central well;

a connector plate comprising a sheet of material having an outer ridge including outer and inner raised walls and a depressed groove formed concentric to and in spaced relation to the outer ridge, the groove defining a cavity on a lower surface of the connector plate configured to receive an upper portion of the cup or a lid thereof therein; and an upper tray comprising a sheet of material having a smaller diameter than the base tray and having an outer ridge including a raised outer wall and a raised inner wall spaced apart from one another to define a groove on a bottom surface of the upper tray configured to receive the outer ridge of the connector plate, and a support ridge formed concentric to and in space relation to the outer ridge and including a raised outer wall and a sloped raised inner wall defining a periphery of well base platform and including a plurality of shrimp each having a concave bottom surface supported by the support ridges of the base and upper trays and arranged side by side to one another so as to form a ring structure on the base and upper trays.

11. The tiered shrimp tray of claim 9, wherein the outer ridge and the support ridge of each of the base and upper trays are generally annular.

12. The tiered shrimp tray of claim 9, including a second cup disposed within a well of the upper tray defined by the support ridge and a base surface.

13. The tiered shrimp tray of claim 11, wherein each shrimp has a tail end directed towards the cup of the base or upper tray, and a head end directed towards the outer ridge.

14. A tiered shrimp tray, comprising:

a base tray comprising a sheet of material having an outer ridge, a support ridge formed concentric to and in spaced relation to the outer ridge; and an inner ridge and a base surface cooperatively defining a central well;

a cup disposed within the central well;

a connector plate comprising a sheet of material having an outer ridge and a groove concentric to and in spaced relation to the outer ridge, the groove defining a cavity on a lower surface of the connector plate configured to receive an upper portion of the cup therein;

an upper tray comprising a sheet of material having a smaller diameter than the base tray and having an outer ridge defining a groove on a bottom surface of the upper tray configured to receive the outer ridge of the connector plate, and a support ridge formed concentric to and in spaced relation to the outer ridge and defining a periphery of a well base platform;

a second cup disposed on the well base platform of the upper tray; and a plurality of shrimp each having a concave bottom surface supported by the support ridges of the base and upper trays and arranged side by side to one another, with a tail end directed towards the cup and a head end directed towards the outer ridge so as to form a ring structure on the base and upper trays.

15. The tiered shrimp tray of claim 12, wherein the outer ridge of the base tray and the upper tray each include an outer wall connected to an inner wall at an upper portion thereof, and in spaced relation at a lower portion thereof.

16. The tiered shrimp tray of claim 12, wherein the support ridge of the base tray and the upper tray each include an outer wall connected to an inner wall having a sloped surface.

17. The tiered shrimp tray of claim 12, wherein the outer ridge and the support ridge of each of the base and upper trays define a gap having a base surface extending therebetween.

18. The tiered shrimp tray of claim 12, wherein the outer ridge and the support ridge of each of the base and upper trays are generally annular.

* * * * *